US005289662A

United States Patent [19]

Castle

[11] Patent Number: 5,289,662

[45] Date of Patent: Mar. 1, 1994

[54] WALL COPING SYSTEM

[76] Inventor: Gary M. Castle, 9004 Montpelier Dr., Laurel, Md. 20708

[21] Appl. No.: 916,910

[22] Filed: Jul. 22, 1992

[51] Int. Cl.[5] ..... E04H 1/00

[52] U.S. Cl. ..... 52/287.1; 52/58; 52/60; 52/300; 52/718.05

[58] Field of Search ..... 52/58, 96, 300, 60, 52/301, 718.05, 287 R, 287 OR

[56] References Cited

FOREIGN PATENT DOCUMENTS 2213183 9/1973 Fed. Rep. of Germany ..... 52/300

1558024 12/1979 United Kingdom ..... 52/58

*Primary Examiner*—Carl D. Friedman

*Assistant Examiner*—Wynn Wood

*Attorney, Agent, or Firm*—Donald A. Kettlestrings

[57] ABSTRACT

An improved coping system for covering the top of a parapet wall includes a reinforcing plate attached to a conventional splice plate for preventing sagging of the splice plate which can allow collection of water on the splice plate and entry of moisture into the wall. Sealant strips are attached to the reinforcing plate, and the reinforcing plate includes projecting elements which stiffen and reinforce the reinforcing plate and which help to hold the strips in position on the reinforcing plate.

18 Claims, 3 Drawing Sheets

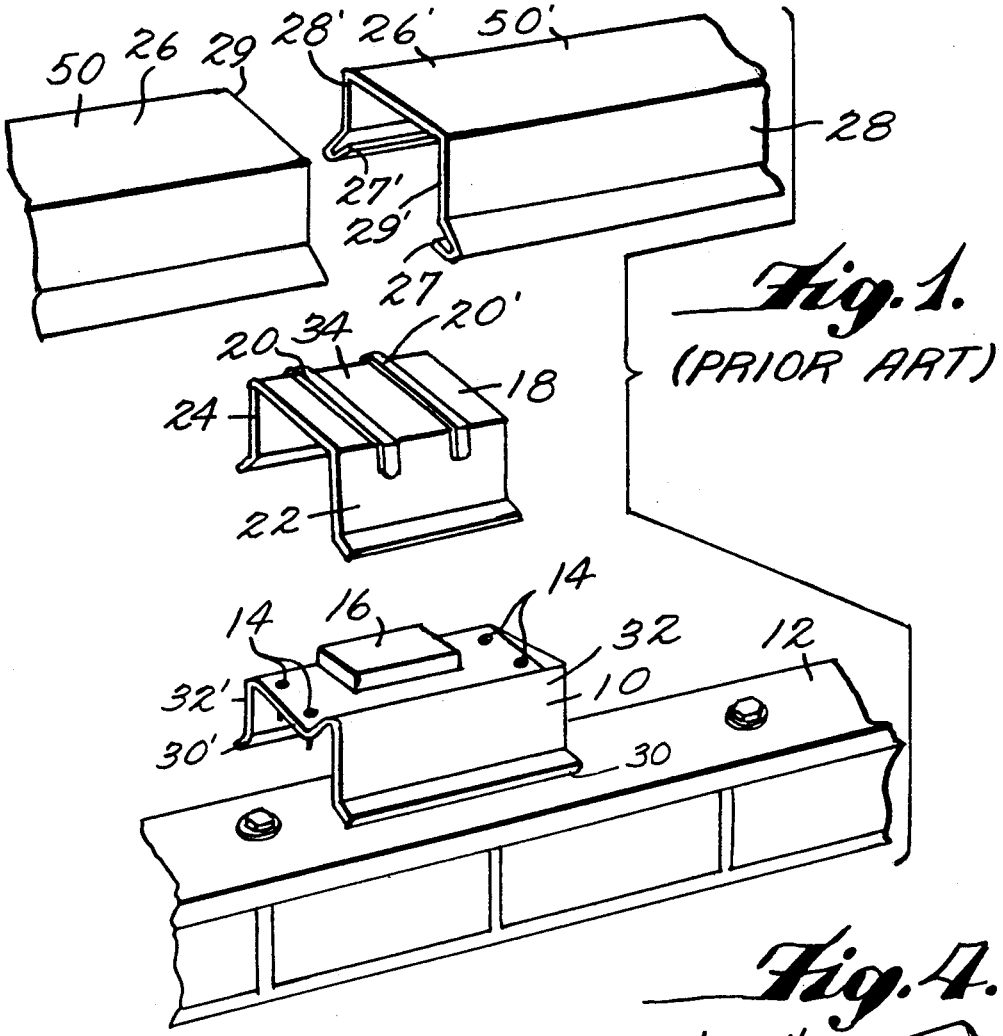
Fig. 1.
(PRIOR ART)
Fig. 4.
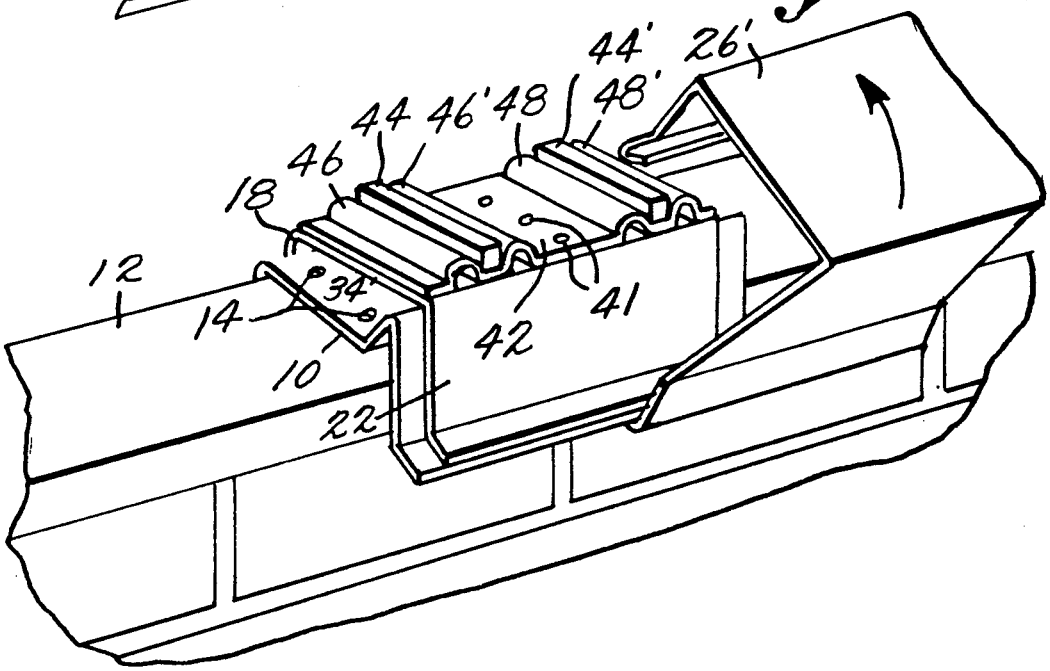

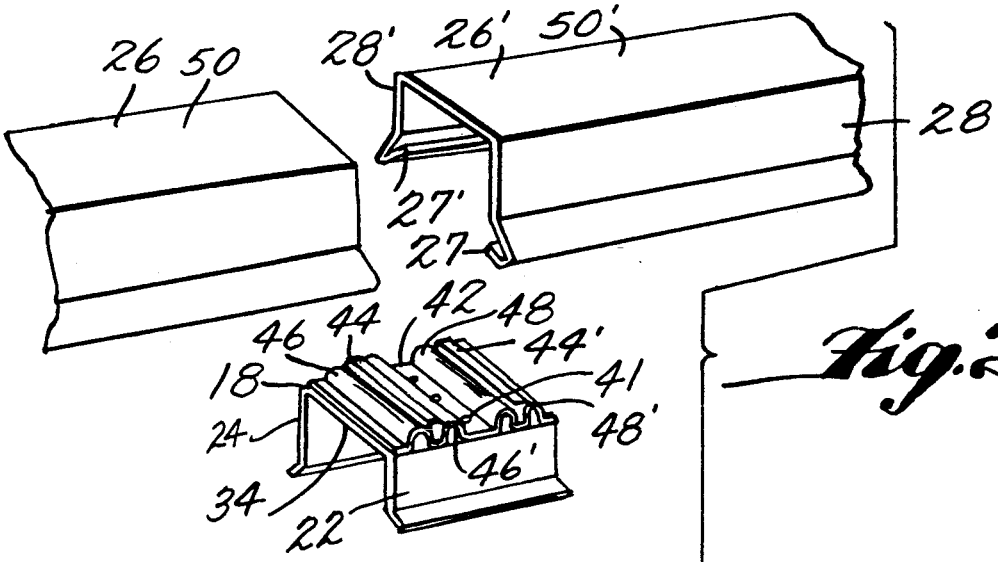
Fig. 2.
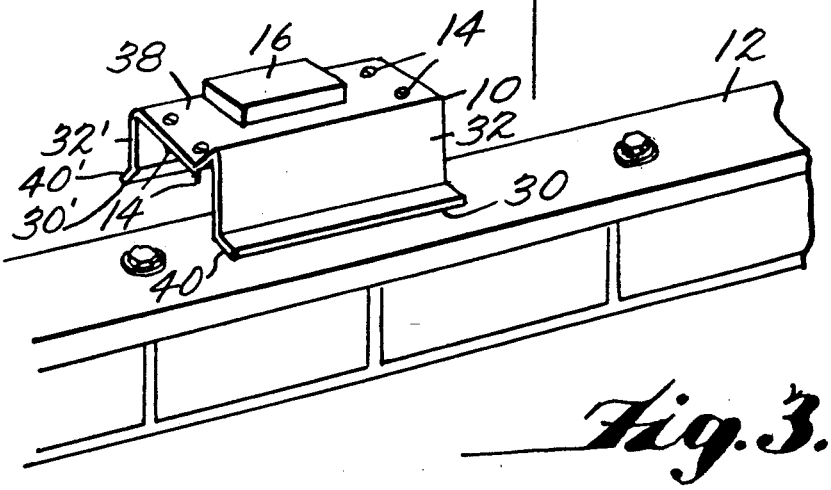
Fig. 3.
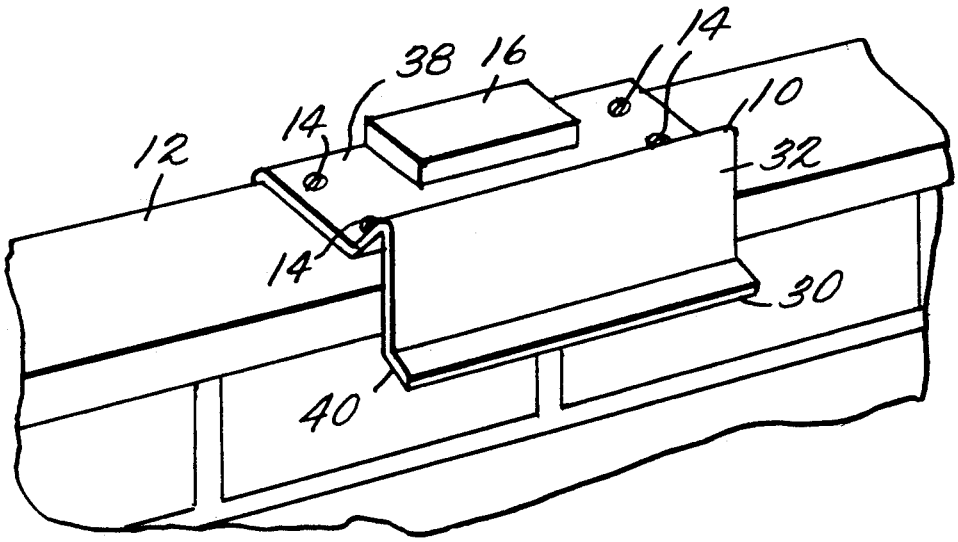

WALL COPING SYSTEM

Many types of coping systems are known for sealing tops of parapet walls and for eliminating exposed fasteners. One such known coping system is shown in FIG. 1.

The known coping system illustrated in FIG. 1 includes a plurality of anchor elements or hold down cleats 10 which are attached at predetermined spaced intervals along the top of wall 12 by screws, bolts or other conventional securing means 14.

Resilient means 16, such as neoprene spacers or compression pads, are placed onto and preferably attached to hold down cleats 10 by adhesive. Support elements or splice plates 18 are positioned on each of anchor elements 10 and on spacers or compression pads 16. Butyl sealant is then applied in the field in two strips 20, 20' on top of gutter splice plate 18 and down front and rear legs 22, 24 approximately one-half inch.

Coping element 26 defines a bottom hook-shaped edge 27 on first or front side 28, and bottom hook edge 27 fully engages bottom edge 30 of a front side 32 of anchor element 10. Coping element 26 is then pivoted into position with bottom hook edge 27' on rear side 28' fully engaging bottom edge 30' of a rear side 32' of anchor element 10. In this position, coping element 26 is pressed firmly against sealant strip 20, and end edge 29 of coping element 26 is positioned between sealant strips 20, 20'.

Adjacent coping element 26' is installed in the same manner leaving approximately a one-quarter inch joint or space between abutting ends 29, 29' of coping elements 26, 26' to allow for thermal expansion.

Although the known coping system described and illustrated in FIG. 1 has served the purpose, it has not been entirely satisfactory because central web portion 34 of splice plate 18 often sags from its own weight or from the weight of water or ice. Such sagging is undesirable because it allows collection of water and also tends to distort and damage sealant strips 20, 20'. This, in turn, allows moisture to pass around or over sealant strips 20, 20' and into wall 12 in an undesirable manner.

It is, therefore, an object of the present invention to provide an improved coping system for covering the top of a parapet wall.

Another object is to provide an improved wall coping system which prevents undesirable entry of moisture into the wall.

A further object of the invention is the provision of an approved wall coping system which is easy and inexpensive to install.

Still another object is to provide an improved wall coping system which eliminates the requirement for applying sealant strips in the field.

A still further object is to provide an improved coping system for covering the top of a parapet wall wherein a central web portion of each splice plate is reinforced for preventing sagging and for preventing entry of moisture into the wall.

Another object is to provide an improved coping system for covering the top of a parapet wall wherein a central web portion of each splice plate is reinforced to stabilize factory applied sealant strips.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

To achieve these and other objects, the present invention provides an improved coping system for covering the top of a parapet wall wherein the improvement comprises a plate element or gutter splice attached to each support element or splice plate; first and second sealant strips attached to each plate element or gutter splice; and reinforcing means in operative relationship with the sealant strips and with each plate element or gutter splice for helping to hold the strips in position on the plate element and for stiffening and reinforcing the plate element.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and, together with the description, serve to explain the principles of the invention.

FIG. 1 is an exploded perspective view of a known, prior art coping system;

FIG. 2 is an exploded perspective view of the improved wall coping system of this invention;

FIG. 3 is a fragmentary perspective view showing the initial steps of installing the improved wall coping system by attaching anchor elements or hold down cleats to the top of the wall and by positioning a compression pad onto each anchor element;

FIG. 4 is a fragmentary perspective view showing further steps of installing the improved wall coping system by installation of support elements or splice plates onto each of the anchor elements and onto the compression pads and showing engagement of a bottom hook edge of a coping element with a bottom edge of an anchor element or hold down cleat;

Figure 5:
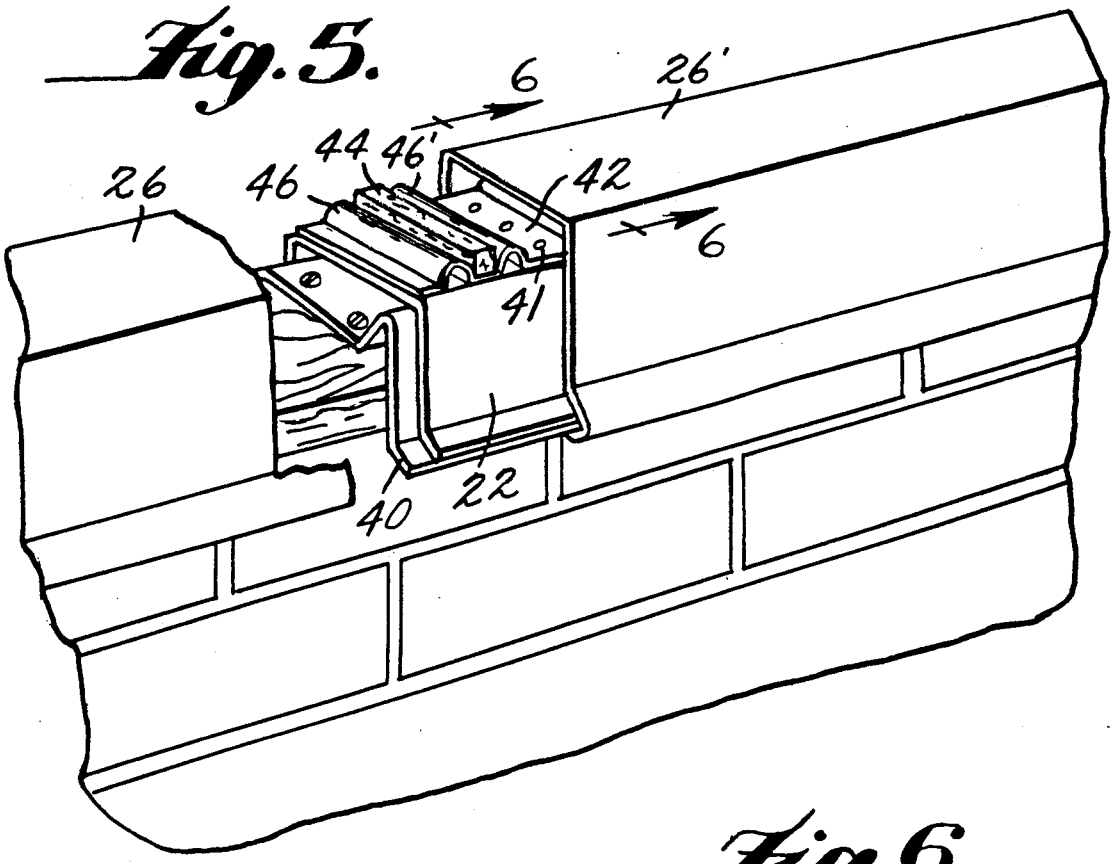
Figure 6:
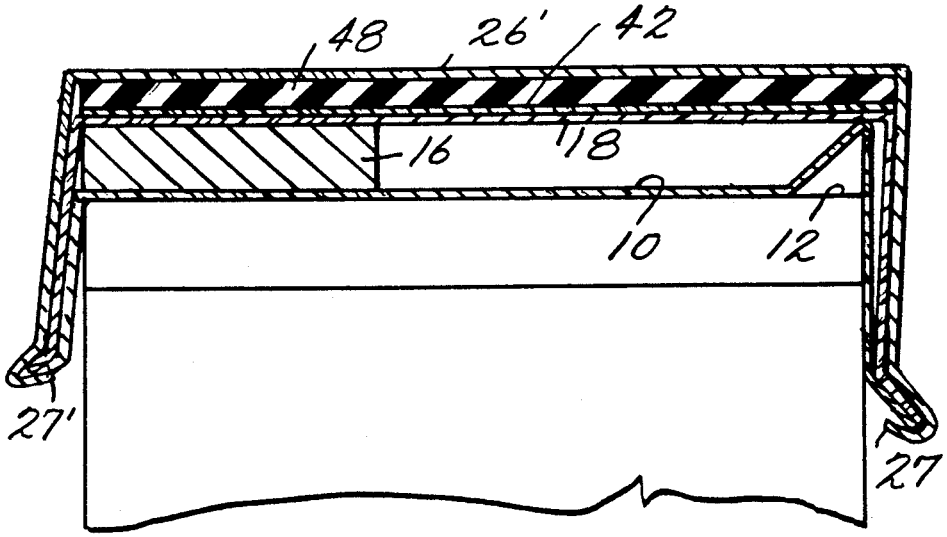

FIG. 5 is a fragmentary perspective view showing further steps of installing the improved wall coping system by engaging bottom hook edges of two coping elements with bottom edges of each anchor element or hold down cleat and leaving a space or joint of approximately one-quarter inch between adjacent coping elements; and FIG. 6 is a cross-sectional view taken along the line 6—6 in FIG. 5 and looking in the direction of the arrows.

With reference now to the drawings, wherein like reference characters designate like or corresponding parts throughout the several views, there is shown in FIGS. 2-6 an improved coping system 36 in accordance with this invention. Coping system 36 includes an anchor element or hold down cleat 10 identical to that illustrated in FIG. 1. Anchor element 10 is of inverted, downwardly open channel shape and defines a first central web 38 of first predetermined length for extending across the top of wall 12. Anchor element 10 includes front and rear sides 32, 32' which extend downwardly from web 38. Each of sides 32, 32' defines an outwardly sloping flange portion 40, 40', respectively, which extends downwardly to bottom edges 30, 30', respectively.

Conventional means 14 are provided for securing a plurality of anchor elements 10 in predetermined space relation along the top of wall 12, and securing means 14 can be screws, bolts or the like.

Resilient means 16 are provided for positioning on web 38 of each of anchor elements 10, and resilient means 16 can be a conventional metallic spring element (not shown) or preferably a conventional neoprene compression pad which is preferably attached to web 38 by means of adhesive.

A support element or splice plate 18 of inverted, downwardly open channel shape, identical to that shown in FIG. 1, defines a second central web 34 substantially equal in length to web 38. Support element or splice plate 18 includes front and rear legs 22, 24 extending downwardly from web portion 34.

The improvement includes a plate element 42 attached by fasteners 41 to web 34, preferably at a plurality of locations. Plate element 42 is of a second predetermined length substantially equal to the first predetermined length of web 38. First and second closed cell neoprene sealant strips 44, 44' are preferably factory applied and attached to plate element 42 by adhesive, and each of strips 44, 44' extends substantially along the entire length of plate element 42.

In accordance with the invention, reinforcing means or projecting elements 46, 46', 48 and 48' are provided in operative relationship with sealant strips 44, 44' and are attached to or made integral with plate element 42 for helping to hold strips 44, 44' in position on plate element 42 and for stiffening and reinforcing plate element 42. Each of projecting elements 46, 46', 48 and 48' is preferably of an inverted, downwardly open channel shape defining a substantially semi-circular cross section, but other cross-sectional shapes can be used.

Conventional coping elements 26, 26' are each of inverted, downwardly open channel shape and each defines a third central web 50, 50' which is substantially equal in length to webs 34, 38. Each of coping elements 26, 26' includes first and second sides 28, 28' extending downwardly from webs 50, 50' to define bottom hook edges 27, 27', respectively, for respective engagement with sloping flange portions 40, 40' of anchor element 10.

In use of the improved coping system of this invention, a plurality of anchor elements or hold down cleats 10, as illustrated in FIG. 3, are attached at predetermined spaced intervals along the top of wall 12 by screws, bolts or other conventional securing means 14. Neoprene spacers or compression pads 16 are placed onto and preferably attached to each of hold down cleats 10 by adhesive. Support elements or splice plates 18, each having a plate element 42 attached thereto as previously described, (FIG. 4) are positioned, one each on each of anchor elements 10 and on spacers or compression pads 16.

Coping elements 26, 26' are then attached as previously described with bottom hook edge 27 engaging bottom edge 30 of a front side 32 of anchor element 10. Each coping element 26, 26' is then pivoted into position with bottom hook edge 27' on rear side 28' fully engaging bottom edge 30' of a rear side 32' of anchor element 10. This is shown in FIGS. 4 and 5.

In the assembled position, web 50 of coping element 26 will press firmly and in sealing relationship against sealant strip 44, and web 50' of coping element 26' will press firmly and in sealing relationship against sealant strip 44'. Adjacent coping elements 26, 26' will be installed with approximately a one-quarter inch joint or space between abutting ends 29, 29' to allow for thermal expansion.

Plate element 42, attached to web 34 of splice plate 18, reinforces central web portion 34 to prevent sagging of web portion 34 from its own weight or as a result of collection of water or ice on web portion 34. Such sagging is undesirable because it allows collection of water or ice on web 34, and sagging of web 34 would permit moisture to enter wall 12 as a result of bypassing the sealant strips. Each of projecting elements 46, 46', 48 and 48' provides stiffening and reinforcing for plate element 42 to prevent sagging of plate element 42, and the projecting elements also help to hold sealant strips 44, 44' in fixed positions on plate element 42 so that the sealant strips provide effective sealing with coping elements 26, 26' to prevent entry of water into wall 12.

In accordance with the invention, each of sealant strips 44, 44' is preferably comprised of closed cell neoprene. Each of plate element 42, splice plate 18 and coping elements 26, 26' are preferably made of the same material and are of the same color on their exterior surfaces. By providing the elements of the same color, coping system 36 will be more aesthetically pleasing to the eye and splice plate 18 and plate element 42 will not be easily visible at the space formed between coping elements 26, 26'.

Each of anchor elements 10, splice plates 18, plate elements 42, projecting elements 46, 46', 48 and 48' and coping elements 26, 26' are preferably fabricated from heavy gauge (0.040–0.125) aluminum or prefinished PAC-CLAD 22 gauge and 24 gauge, G-90 galvanized steel. The aluminum elements are preferably provided in stock PAC-CLAD Kynar 500 anodized finishes, mill finishes or other specified finishes.

The invention in its broader aspects is not limited to the specific details shown and described, and departures may be made from such details without departing from the principles of the invention and without sacrificing its chief advantages.

What is claimed is:

1. A coping system for covering the top of a parapet wall, said system comprising:

an anchor element of inverted, downwardly open channel shape defining a first central web of first predetermined length for extending across the top of the wall and having front and rear sides extending downwardly from said web to define bottom edges, each of said sides defining an outwardly sloping flange portion adjacent to said bottom edge;

means for use in operative relationship with said anchor element for securing a plurality of said anchor elements in predetermined spaced relation along the top of said wall;

a resilient means for positioning on said first web;

a support element of inverted, downwardly open channel shape defining a second central web of substantially said first predetermined length for resting on said anchor element and on said resilient means and having front and rear legs extending downwardly from said second web;

a plate element attached to said second web, said plate element of a second predetermined length substantially equal to said first predetermined length;

first and second sealant strips attached to said plate element, each of said strips extending substantially along the entire length of said plate element;

reinforcing means in operative relationship with said sealant strips and with said plate element for helping to hold said strips in position on said plate element and for stiffening and reinforcing said plate element; and coping elements, each of said coping elements of inverted, downwardly open channel shape, defining a third central web of substantially said first predetermined length and having first and second sides extending downwardly from said third web to define bottom hook edges for engagement with said sloping flange portions of said anchor element, whereby said coping elements are positioned in sealing relationship on said sealant strips for directing water passing between ends of said coping elements to a side of said wall.

2. A coping system as in claim 1 wherein said reinforcing means include:

first and second projecting elements attached to said plate element, positioned on each side of said first sealant strip and extending substantially along the entire length of said first sealant strip; and third and fourth projecting elements attached to said plate element, positioned on each side of said second sealant strip and extending substantially along the entire length of said second sealant strip.

3. A coping system as in claim 2 wherein said sealant strips are comprised of closed cell neoprene.

4. A coping system as in claim 3 wherein each of said sealant strips is attached to said plate element by adhesive.

5. A coping system as in claim 4 wherein said support element, said plate element and said coping elements are made of the same material and are of the same color.

6. A coping system as in claim 5 wherein said anchor element, said support element, said plate element and said coping elements are comprised of aluminum.

7. A coping system as in claim 5 wherein said anchor element, said support element, said plate element and said coping elements are comprised of steel.

8. A coping system as in claim 2 wherein each of said first, second, third and fourth projecting elements is of an inverted, downwardly open channel shape defining a substantially semi-circular cross section.

9. A coping system as in claim 8 wherein each of said projecting elements is integrally formed with said plate element to provide rigidity to said plate element.

10. In a coping system for covering the top of a parapet wall wherein the system includes an anchor element of inverted, downwardly open channel shape defining a first central web of first predetermined length for extending across the top of the wall and having front and rear sides extending downwardly from said web to define bottom edges, each of said sides defining an outwardly sloping flange portion adjacent to said bottom edge; fasteners for securing a plurality of said anchor elements in predetermined spaced relation along the top of said wall; resilient means for positioning on said first web; a support element of inverted, downwardly open channel shape defining a second central web of substantially said first predetermined length for resting on said anchor element and on said resilient mans and having front and rear legs extending downwardly from said second web; and coping elements of inverted, downwardly open channel shape defining a third central web of substantially said first predetermined length and having first and second sides extending downwardly from said third web to define bottom hook edges for engagement with said sloping flange portions of said anchor element, the improvement comprising:

a plate element attached to said second web of said support element, said plate element of a second predetermined length substantially equal to said first predetermined length;

first and second sealant strips attached to said plate element, each of said strips extending substantially along the entire length of said plate element; and reinforcing means in operative relationship with said sealant strips and with said plate element for helping to hold said strips in position on said plate element and for stiffening and reinforcing said plate element.

11. The improvement as in claim 10 wherein said reinforcing means include:

first and second projecting elements attached to said plate element, positioned on each side of said first sealant strip and extending substantially along the entire length of said first sealant strip; and third and fourth projecting elements attached to said plate element, positioned on each side of said second sealant strip and extending substantially along the entire length of said second sealant strip.

12. The improvement as in claim 11 wherein said sealant strips are comprised of closed cell neoprene.

13. The improvement as in claim 12 wherein each of said sealant strips is attached to said plate element by adhesive.

14. The improvement as in claim 13 wherein said plate element, said support element and said coping elements are made of the same material and are of the same color.

15. The improvement as in claim 14 wherein said anchor element, said support element, said plate element and said coping elements are comprised of aluminum.

16. The improvement as in claim 14 wherein said anchor element, said support element, said plate element and said coping elements are comprised of steel.

17. The improvement as in claim 11 wherein each of said first, second, third and fourth projecting elements is of an inverted, downwardly open channel shape defining a substantially semi-circular cross section.

18. The improvement as in claim 17 wherein each of said projecting elements is integrally formed with said plate element to provide rigidity to said plate element.

* * * * *